United States Patent [19]

Kaminstein

[11] 4,346,890

[45] Aug. 31, 1982

[54] LEATHER GRIP

[76] Inventor: Bernard Kaminstein, 329 Franklin, Paramus, N.J. 07652

[21] Appl. No.: 6,459

[22] Filed: Jan. 25, 1979

[51] Int. Cl.[3] ..... A63B 49/08; B32B 9/02

[52] U.S. Cl. ..... 273/73 J; 273/81.5; 428/473; 428/540

[58] Field of Search ..... 273/65 EG, 73 J, 75, 273/81 R, 81.5, 81.6; 427/264, 355, 358, 359; 231/2 R; 428/473, 540, 543

[56] References Cited

U.S. PATENT DOCUMENTS

| | | | |
|---|---|---|---|
| 187,916 | 2/1877 | Scharff | 231/2 R |
| 1,677,435 | 7/1928 | Dunham | 428/473 X |
| 1,701,856 | 2/1929 | Kraeuter | 273/81 R |
| 2,020,048 | 11/1935 | Cook et al. | 231/2 R X |
| 2,115,119 | 4/1938 | Park | 273/81 R |
| 2,195,626 | 4/1940 | Lamkin | 273/81.6 |
| 2,282,419 | 5/1942 | Hall | 273/75 |
| 2,446,622 | 8/1948 | Turner | 273/81.6 X |
| 2,671,661 | 3/1954 | Goodwin | 273/81.6 |
| 3,183,119 | 5/1965 | Broadhead | 428/473 X |
| 4,053,676 | 10/1977 | Kaminstein | 273/75 X |

FOREIGN PATENT DOCUMENTS

| | | | |
|---|---|---|---|
| 296372 | 11/1929 | United Kingdom | 428/473 |
| 668249 | 3/1952 | United Kingdom | 273/81.6 |
| 799061 | 7/1958 | United Kingdom | 428/540 |
| 1040534 | 8/1966 | United Kingdom | 428/540 |

OTHER PUBLICATIONS

"The Leatherworker's Handbook", by J. H. Sharphouse; Nov. 1963; pp. 161–164 and 169–173.

*Primary Examiner*—Richard J. Apley

*Attorney, Agent, or Firm*—Stephen E. Feldman; Marvin Feldman; Jules L. Chaboty

[57] ABSTRACT

An improved leather grip is disclosed wherein leather strapping for a handle is treated with a tackifier resin, the surface roughened, and a solvent applied to the leather surface. A wax-solvent solution may also be used in treating the leather. The improved hand grip is useful in improving the grip on sporting equipment such as golf clubs and tennis racquets.

8 Claims, 2 Drawing Figures

LEATHER GRIP

FIELD OF THE INVENTION

This invention relates to leather grips. Specifically this invention relates to improved gripping of leather for use in hand grips.

BACKGROUND AND DISCUSSION OF THE PRIOR ART

It was generally known in the prior art to apply coatings to hand grip surfaces to improve the adhesiveness of the grip surface.

One earlier approach was to apply a rubber and solvent coating to leather handles such as is disclosed in Sellars et al, U.S. Pat. No. 1,293,949, granted Feb. 11, 1919.

A more recent approach was to provide a coating of a vinyl copolymer resin binder with expanded micropores to improve the non-slip character of a handle grip, as disclosed in Kaminstein, U.S. Pat. No. 4,053,676, granted Oct. 11, 1977.

Another approach was to provide inequal portions of handle to improve the grip quality. Hall, U.S. Pat. No. 2,282,419, granted May 12, 1942 discloses thicker and thinner leather portions of a grip piece.

Now there is provided by the present invention a leather grip which avoids specialized coatings of the prior art, while improving the gripping character of the leather itself.

It is therefore a principal object of this invention to provide an improved leather grip and a method for making same.

It is a further object of this invention to provide a leather grip as aforesaid in which leather is readily treated in relatively inexpensive manner of operations.

It is still a further object of this invention to provide an improve grip character to the leather without coating the leather thereby retaining the leather feel.

It is a further object of this invention to provide leather grips of sufficient non-slip character so as to be useful in sporting equipment.

It is a further object of this invention to improve a grip surface of a leather handle without impairing the aesthetic value of the leather handle appearance and feel.

The aforesaid as well as other objects and advantages will become apparent from a reading of the following description, the adjoined claims and the drawings in which:

FIG. 1 is a schematic illustration of the method for making a leather grip for a tennis racket; and FIG. 2 is an enlarged sectional view taken along line 2—2 of FIG. 1.

DESCRIPTION OF THE PREFERRED EMBODIMENT

Broadly speaking this present invention in one aspect comprises a leather piece covering a handle, wherein the leather comprises a resin, and a organic solvent within the leather.

In another aspect the present invention is a method for providing the improved grip character to leather wherein a resin is provided in the leather and the leather abraded and then an organic solvent absorbed into the leather. With drying the grip character of the leather is improved, without impairing the the aesthetic quality of natural leather handles.

Figure 1:
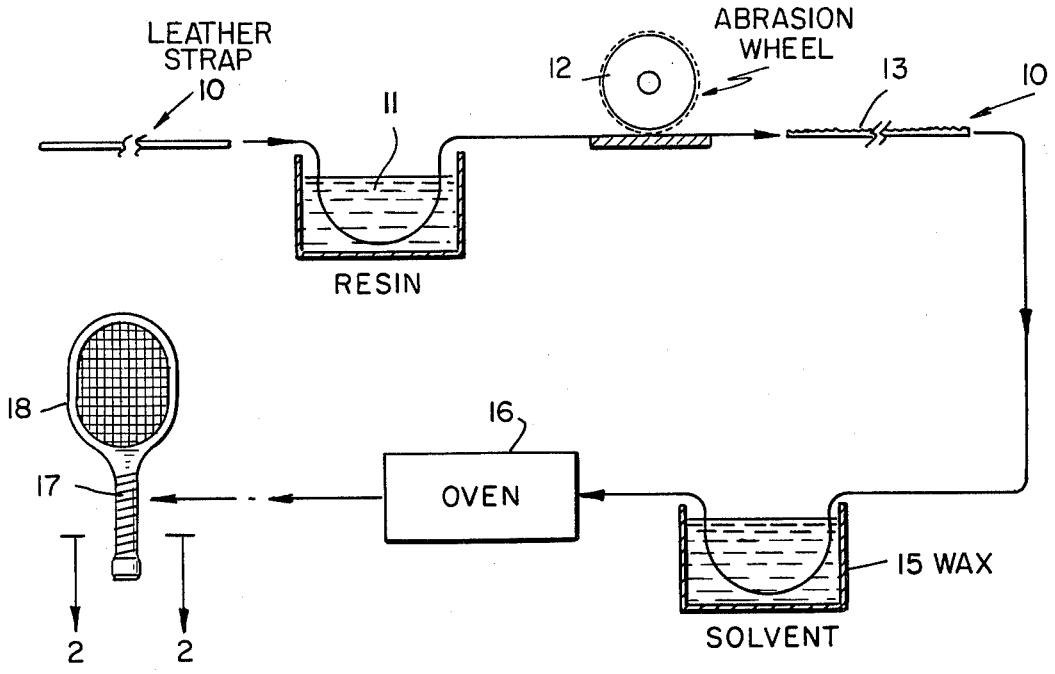

Referring specifically to FIG. 1, there is shown a natural leather strap 10 having pores therein. Strap 10 is treated with a resinous solution 11 to provide a thermo plastic material in the structure, as is well known in the art. Resins such as the acrylics have been successfully added to leather in the prior art, to principally, increase the wear character of the leather. Suitable resinous plastics useful in incorporating in the leather include polyvinyl esters (e.g. polyvinyl acetate, homopolymers and copolymers); polyacrylics (e.g. polymethyl methacrylate); polystyrene; polybutadienes and copolymer thereof such as the block copolymers (e.g. carboxy modified butadrene-acrylonitute); polyvinylhalogens (e.g. polyvinyl chloride); polyvinylidene chloride; nitrides, neoprene and the like. Solvents and plasticizer are added to the plastic to aid in this treatment step, as is well known to the skilled practitioner. The plasticizers which may be used, are compositions well known in the art and include among others, for instance, tricresyl phosphate, dibutyl phthalate, dioctyl phthalate, polycarboxylic acid polyesters of a nuclearly halogenated aryl ether alcohol, for instance, di-(parachlorophenylethyl)sebacate, etc.; butyl phthalyl butyl glycolate, dioctyl sebacate, di-(2-ethylhexyl) tetrachlorophthalate, ethylene, glycol dioleate, polyester plasticizer, e.g., the Paraplexes, etc. Resinous leathers are commercially available.

After the resin 11 is incorporated in the leather, the leather is then abraded by suitable abrading means 12, such as sanders, buffers, metal brushes, the like.

Once the leather surface 13 is roughened, the strap 10 is passed through an organic solvent at an elevated temperature above ambient but less than the vaporization temperature of the solvent. Suitable organic solvents pursuant to the present invention include the aliphatic and aromatic solvents, preferrably the aromatics such as benzene, xylene and toluene. It has been found that toluene is most preferred.

In a further improvement it has been found that a wax when incorporated into the solvent to go into a solvated form further improves the grip character. Suitable waxes include beeswax, microcrystalline waxes, and the like. Most preferred is beeswax. The wax is present in from 5 to 15 percent by weight of the total solution and preferrably about 5 percent by weight.

After solution treatment the strap 10 is dried in oven 16 and then bonded to wooden handle 17 of tennis racquet 18.

Figure 2:
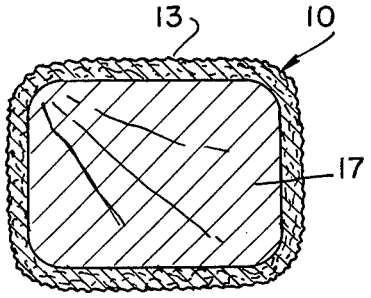

Referring to FIG. 2 the roughened surface 13 in combination with the resin-solvent treated leather provides improved tackiness, slip-resistant character and is particularly useful in sporting equipment.

The organic solvent of the present invention may be applied by any suitable method known to one in the art including spraying, brushing and the like. It is preferrably desirable to absorb the solvent throughout the porous leather.

There has accordingly been described herein a novel leather grip material which provides a non-slip grip to the handle. While there has been described certain preferred embodiments, various modification can be made within the scope and spirit of the invention and defined in the adjoined claims.

What is claimed is:

1. An improved leather grip comprising a base handle and a porous natural leather piece covering said handle, said leather piece comprising an outer roughened gripping surface, the structure of said leather piece on and below said surface and within said leather including an incorporated tackifier resinous thermoplastic material in the structure, said thermoplastic material including a thermoplastic plastic selected from the group consisting of a polyvinyl ester, a polyacrylic, polystyrene, a polybutadiene or copolymer thereof, a polyvinylhalogen, polyvinylidene chloride, a nitride, and neoprene, said thermoplastic material including a first solvent, and also including a plasticizer selected from the group consisting of tricresyl phosphate, dibutyl phthalate, dioctyl phthalate, a polycarboxylic acid polyester of a nuclearly halogenated aryl ether alcohol, butyl phthalyl butyl glycolate, dioctyl sebacate, di-(2-ethylhexyl) tetrachlorophthalate, ethylene, glycol dioleate, and a polyester plasticizer, said structure of said leather piece having an organic second solvent solution selected from the group consisting of an aliphatic solvent, benzene, xylene and toluene, and containing in solution a solvated form of a wax selected from the group consisting of beeswax and a microcrystalline wax, formed and absorbed into, and dispersed throughout, said porous leather piece on and below said roughened surface, said wax being present in from about 5 percent by weight to 15 percent by weight of the total solution, said leather piece being in the form of a strip which is wound around said handle and bonded thereto.

2. The leather grip of claim 1 wherein said wax is about 10 percent by weight of said solution.

3. A method for forming an outer roughened gripping surface on a porous natural leather piece, and thereby improving the grip of leather, comprising:

(a) providing a porous natural leather piece;

(b) incorporating into the structure of said leather piece, on and below said surface and within said leather, an included tackifier resinous thermoplastic material in the structure, said thermoplastic material including a thermoplastic plastic selected from the group consisting of a polyvinyl ester, a polyacryllic, polystyrene, a polybutadiene or copolymer thereof, a polyvinylhalogen, polyvinylidene chloride, a nitride, and neoprene, said thermoplastic material including a first solvent, and also including a plasticizer selected from the group consisting of tricresyl phosphate, dibutyl phthalate, dioctyl phthalate, a polycarboxylic acid polyester of a nuclearly halogenated aryl ether alcohol, butyl phthalyl butyl glycolate, dioctyl sebacate, di-(2-ethylhexyl) tetrachlorophthalate, ethylene, glycol dioleate, and a polyester plasticizer;

(c) roughening at least said surface of the leather;

(d) absorbing into said leather piece, on and below said roughened surface, by applying onto said roughened surface by spraying or brushing, and forming into and dispersing throughout said roughened surface, an organic second solvent solution selected from the group consisting of an aliphatic solvent, benzene, xylene and toluene, said second solvent containing in solution a solvated form of a wax selected from the group consisting of beeswax and a microcrystalline wax; and (e) drying said leather piece, so that said wax containing second solvent is dispersed in and absorbed throughout the porous leather piece.

4. The method of claim 3, wherein said roughening is by an abrasive surface.

5. The method of claim 4, wherein the abrasive surface comprises a sander or a buffer or a metal brush.

6. The method of claim 3, wherein the second solvent is sprayed on the leather, and wherein said second solvent is heated to an elevated temperature above ambient but below its vaporization temperature.

7. The method of claim 3, wherein the wax is present in from about 5 percent by weight to 15 percent by weight of the total solution.

8. The method of claim 7, wherein said wax is about 10 percent by weight of said solution.

* * * * *